United States Patent [19]

Tutzer

[11] Patent Number: 4,953,472

[45] Date of Patent: Sep. 4, 1990

[54] RAIL VEHICLE, PARTICULARLY MONORAIL

[75] Inventor: Peter Tutzer, Kornwestheim, Fed. Rep. of Germany

[73] Assignee: Von Roll Transportsysteme AG, Thun, Switzerland

[21] Appl. No.: 228,037

[22] Filed: Aug. 4, 1988

Related U.S. Application Data

[63] Continuation of Ser. No. 96,332, Sep. 14, 1987, abandoned.

[30] Foreign Application Priority Data

Sep. 16, 1986 [DE] Fed. Rep. of Germany ..... 3631461
Jan. 31, 1987 [DE] Fed. Rep. of Germany ..... 3702900

[51] Int. Cl.[5] ..... B61G 5/02

[52] U.S. Cl. ..... 105/4.3; 105/4.2; 105/144; 105/199.2

[58] Field of Search ..... 105/4.2, 4.3, 4.4, 4.1, 105/141, 144, 157.1, 182.1, 199.1, 199.5, 3; 104/118

[56] References Cited

U.S. PATENT DOCUMENTS

| | | | |
|---|---|---|---|
| 1,640,179 | 8/1927 | Buckwalter | 105/182.1 |
| 2,605,718 | 8/1952 | Omar et al. | 105/4.3 |
| 2,812,726 | 11/1957 | Bock et al. | 105/4.4 |
| 2,816,517 | 12/1957 | Candlin, Jr. et al. | 105/4.3 |
| 3,528,374 | 9/1970 | Wickens | 105/4.1 |
| 4,238,006 | 12/1980 | Jackson et al. | 105/199.1 |
| 4,258,629 | 3/1981 | Jackson et al. | 105/199.1 |
| 4,699,065 | 10/1987 | Kibble | 105/199.5 |

FOREIGN PATENT DOCUMENTS

| | | | |
|---|---|---|---|
| 146314 | 11/1950 | Australia . | |
| 258028 | 7/1963 | Australia . | |
| 405152 | 10/1970 | Australia . | |
| 475945 | 1/1975 | Australia . | |
| A36406 | 6/1986 | Australia . | |
| 259032 | 8/1911 | Fed. Rep. of Germany . | |
| 309389 | 6/1917 | Fed. Rep. of Germany . | |
| 0923972 | 2/1955 | Fed. Rep. of Germany | 105/4.1 |
| 10042163 | 3/1957 | Fed. Rep. of Germany . | |
| 1126904 | 4/1962 | Fed. Rep. of Germany . | |
| 1142381 | 1/1963 | Fed. Rep. of Germany | 105/3 |
| 1161936 | 1/1964 | Fed. Rep. of Germany . | |
| 1212576 | 3/1966 | Fed. Rep. of Germany . | |
| 1243712 | 7/1967 | Fed. Rep. of Germany . | |
| 1283258 | 11/1968 | Fed. Rep. of Germany . | |
| 1284443 | 12/1968 | Fed. Rep. of Germany . | |
| 1810009 | 8/1969 | Fed. Rep. of Germany . | |
| 2807984 | 8/1978 | Fed. Rep. of Germany . | |
| 0329987 | 6/1958 | Switzerland | 105/4.1 |
| 332379 | 8/1958 | Switzerland . | |
| 791341 | 2/1958 | United Kingdom . | |
| 1067966 | 5/1967 | United Kingdom . | |
| 1120160 | 7/1968 | United Kingdom . | |
| 1130172 | 10/1968 | United Kingdom . | |
| 1333132 | 10/1973 | United Kingdom . | |

*Primary Examiner*—Andres Kashnikow
*Assistant Examiner*—Christopher Trainor
*Attorney, Agent, or Firm*—Cushman, Darby & Cushman

[57] ABSTRACT

A rail vehicle, particularly a monorail, has several vehicles or cars, each of two adjacent or neighboring ones of which are connected by way of an associated coupling device. Between each two adjacent vehicles or cars there is mounted a bogie with an axle suspension for supporting wheels and guide wheels running on a track. A guide arrangement is provided between the adjacent vehicles or cars. This guide arrangement together with a connecting joint of the coupling device forms a single substantially vertical steering axis. This single substantially vertical steering axis passes in a vertical median longitudinal plane of the vehicles or cars both through the connecting joint and through bogie-side guide rod bearings and through a wheel axle of the supporting wheels, so that, particularly with regard to quiet travel and straight line passage, the dynamics of vehicle travel or movement are improved.

24 Claims, 7 Drawing Sheets

F
F
1
2a
2
23
5
22
14
19
21
15
26
20
9
8

RAIL VEHICLE, PARTICULARLY MONORAIL

CROSS-REFERENCE TO RELATED APPLICATION

This application is a continuation of the commonly assigned co-pending United States application Ser. No. 07/096,332, filed on Sept. 14, 1987, now abandoned, and entitled "RAIL VEHICLE, PARTICULARLY MONORAIL".

BACKGROUND OF THE INVENTION

The present invention relates to a new and improved construction of a rail or track-bound vehicle, particularly a monorail or monorail vehicle.

Generally speaking, the rail vehicle, particularly the monorail, is of the type comprising a plurality of vehicles or cars, wherein adjacent or neighboring ones of such vehicles or cars are operatively interconnected or coupled with one another by means of an associated coupling device. Between each two adjacent or neighboring vehicles or cars there is arranged a bogie or the like provided with an axle suspension for supporting wheels and guide wheels running on a track.

A monorail with a bogie having an axle suspension for supporting wheels and guide wheels and located between the vehicles or cars to be coupled is known in this technology. At each of the ends of this bogie, there is located a respective coupling device, at which the coupled vehicles or cars are held so as to each pivot about a vertical steering axis. Supporting wheels are mounted on a transverse wheel axle located between these two coupling devices or between these steering axes.

In such a known coupling device construction, the forces cannot be directly introduced into the supporting wheels, so that in the case of an unequal or irregular vehicle or car weight, there results a pivoting or turning of the bogie about its transverse axis. To obtain an equilibrium condition or state, there occurs an additional loading of the spring suspension, and thus it is necessary that such spring suspension be designed to meet this requirement. During rotation of the bogie about a vertical axis located roughly or approximately centrally between both of the vertical steering axes, a movement of the vehicle or car in the transverse direction is obtained, so that it is placed into oscillations or vibrations. Also a transverse force acting on the vehicle or car can lead to a disadvantageous rotation of the bogie and consequently to rough or disquiet running of the vehicle or car. As a result of a vertical movement of one of the vehicles or cars, due to the two spaced vertical steering axes on the bogie, there results a disadvantageous longitudinal movement of the remainder of the vehicle or car. This leads to rough or disquiet running of the individual vehicle or cars and consequently the train of the monorail system.

SUMMARY OF THE INVENTION

Therefore, with the foregoing in mind, it is a primary object of the present invention to provide a new and improved construction of a rail vehicle, in particular, a monorail which does not exhibit the aforementioned drawbacks and shortcomings of the prior art construction.

Another specific object of the present invention is to provide a new and improved construction of a monorail of the aforementioned type with an axle suspension between the vehicle or cars, which will improve the dynamics of vehicle or car travel or movement, particularly with respect to quiet running and the straight line passage behavior of the vehicle or cars.

Now in order to implement these and still further objects of the invention, which will become more readily apparent as the description proceeds, the rail vehicle of the present invention, particularly the monorail, is manifested by the features that the vehicles or cars are connected to one another by means of a connecting joint of the coupling device. The connecting joint together with a guide arrangement supported on the bogie form a steering axis which, in a vertical median longitudinal plane of the vehicles or cars, passes both through the connecting joint and through bearings or through a joint or hinge means of the guide arrangement on the bogie as well as through a wheel axle of the supporting wheels.

Certain of the main advantages resulting from the present invention are that through the special construction of the axle suspension between the vehicles or cars with a single steering axis located in the coupling point, there is obtained an optimization of the travel dynamics of the train composed of a plurality of vehicles or cars. This is essentially due to the fact that there is no disadvantageous effect on the vehicles or cars in the case of force introduction via the vehicles or cars or via the track, so that with good straight line passage or travel, the quiet running characteristics are improved.

In order to achieve this and in consideration of the construction of the inventive rail vehicle as described heretofore, the two bogie-side bearing points of the guide arrangement and the single articulation or hinge point of the coupling device only form a single steering axis for each two adjacent or neighboring cars which are attached to one another. In addition, the steering axis is located in the substantially vertical median longitudinal plane running through or intersecting the wheel axle. Thus, the effects on the vehicles or cars produced by external forces can be directly transferred or transmitted to the steering axis, so that there are no load-caused or load reversal-caused steering moments and the thus resulting self-imposed or inherent steering behavior of the vehicles or cars.

Transverse forces, for example centrifugal forces, occurring at the vehicles or cars are taken-up or supported by means of guide rods on the steering axis, and rolling movements only occur within the scope of a wheel or tire suspension. No significant vehicle or car movements are caused during steering about the steering axis, due to the fact that there exists only one steering axis, which vehicle or car movements would be of the type otherwise occurring with the known construction equipped with two spaced steering axes of vehicles or cars coupled together. The location of the connecting joint in the steering axis means that, for example, a vehicle or car which is already maneuvering through a curve or bend influences neither by forces nor by movement the following or trailing vehicle or car which is still running on a straight line or course.

According to a particular aspect of the present invention, the guide arrangement comprises substantially triangular guide rods or links, which are arranged in superimposed, roughly or approximately horizontal planes and are supported in articulated or pivoted manner in bearings at a base or bottom portion of a vehicle or car. The supporting of the intercoupled cars in the aforedescribed manner, is accomplished in a special way by means of the related connecting joint located in the associated substantially vertical steering axis and which is supported by means of at least one spring element with respect to the related bogie.

The railway vehicle of the present development furthermore contemplates that the connecting joint of the coupling device is positioned above two bearings and between an upper support arm and a lower support arm of the coupling device. The upper support arm engages over or overlaps the lower support arm. Between a support plate on the lower support arm and a guide rod-fixed carrier plate there is provided a spring element or plurality of spring elements. Each such spring element is only loaded in the straight-up or upright direction by the weight of both vehicles or cars, so that the spring characteristic can be optimally matched or coordinated to this single load. This one loading direction of the spring element is obtained by fixing the carrier plate and support plate to one vehicle or car. It is additionally advantageous if the steering axis through the connecting joint passes through the bogie-side bearings of the two guide rods and through the wheel axle. As a result of these conditions, no relative movement is possible between the support plate on the lower or bottom support arm and the guide rod-fixed carrier plate in the transverse and longitudinal directions. Also no relative rotary movements are possible.

A further aspect of the present development contemplates that the guide arrangement can comprise two superimposed guide rods or guide rod means or else a lower guide rod or guide rod means and an upper joint or pivot structure between the bogie and a vehicle or car.

According to a special development of the present invention, the substantially triangular guide rods or guide rod means can either be articulated to the vehicle or car which is being pulled or drawn or to the vehicle or car which is pulling or doing the drawing. While retaining the advantages of the invention, it is also possible to position the wheel axle upstream or downstream of the substantially vertical steering axis. The steering axis can also be inclined towards or away from the direction of vehicle or car travel, whereby it passes through the wheel axle, and the connecting joint is located in a vertical median longitudinal plane with the bearing joint of the upper guide rod or the upper joint. Considered in the direction of vehicle travel, the connecting joint can also be positioned upstream of the steering axis.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
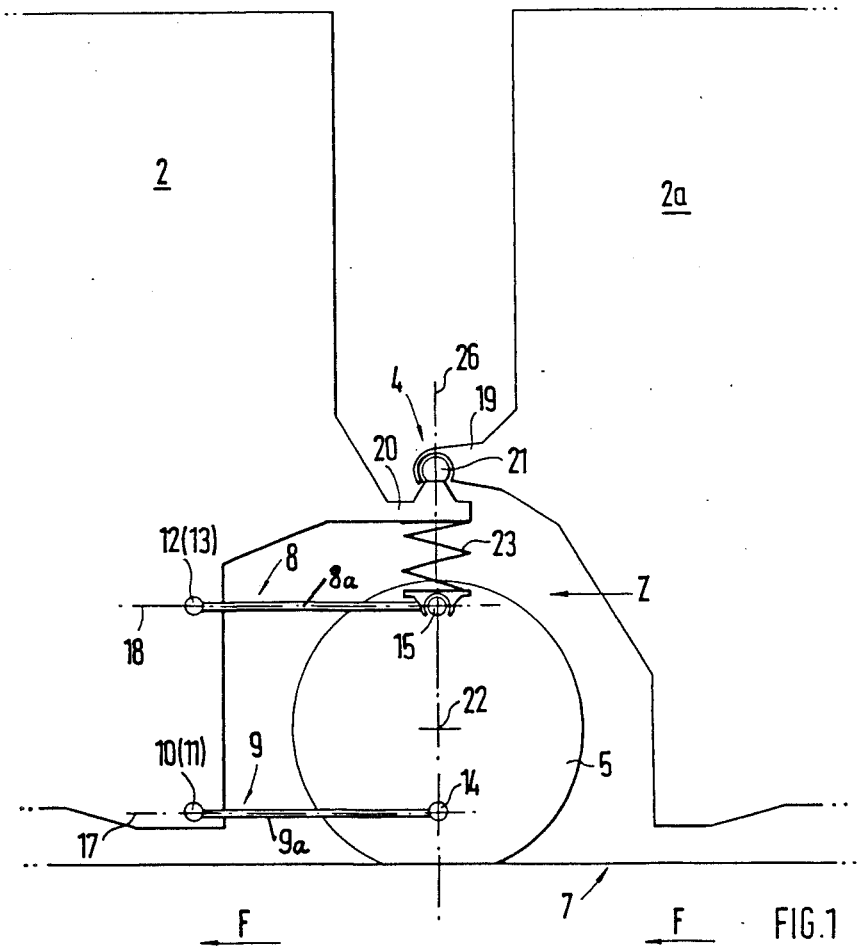
FIG. 1 is a schematic representation of an axle suspension between two vehicle or cars of a monorail or monorail system in side view.

Describing now the drawings, it is to be understood that to simplify the showing thereof, only enough of the structure of the rail vehicle, particularly monorail, has been illustrated therein as is needed to enable one skilled in the art to readily understand the underlying principles and concepts of the present development. Turning attention now specifically to FIG. 1 of the drawings, there has been depicted therein a monorail 1 which essentially comprises a plurality of vehicles or cars 2 and **2*a* and so forth and, for example, between two successive neighboring or adjacently arranged vehicles or cars 2 and 2*a* there is provided a bogie 3 or equivalent structure provided with an axle suspension, generally indicated by reference character 50, as well as a coupling device 4. Supporting wheels 5 and guide wheels 6 running on a track or rail 7 are mounted on the related bogie 3** or the like.

Figure 7:
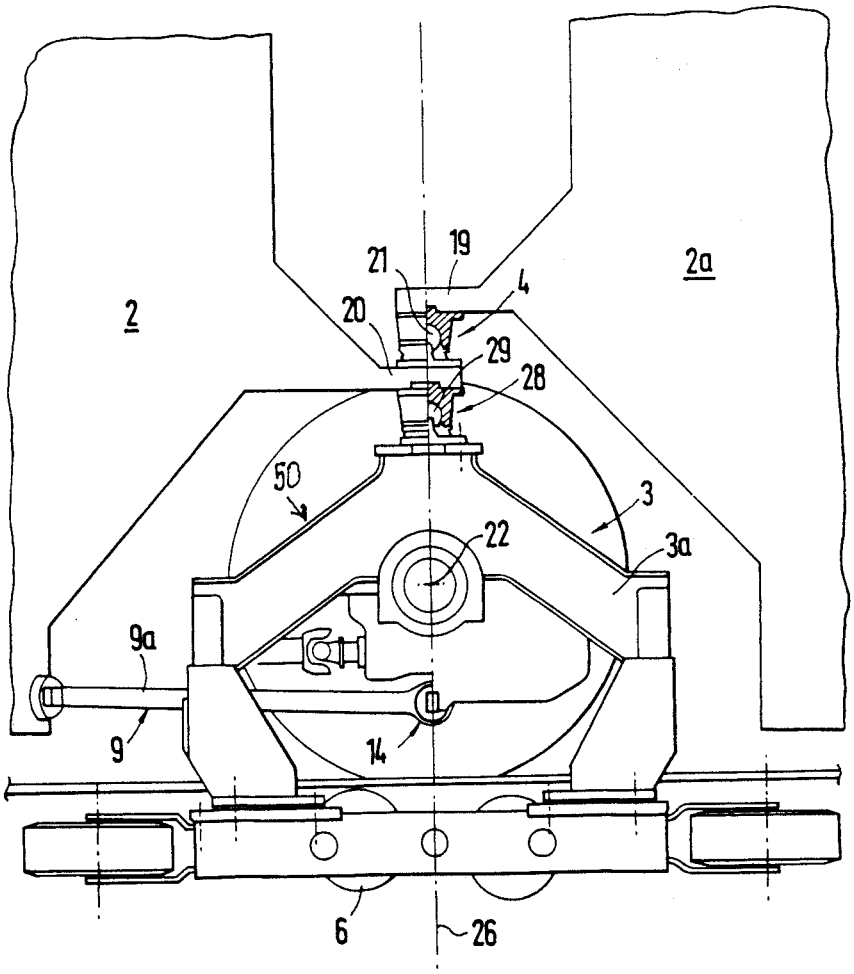
FIG. 7 illustrates yet another construction of a monorail with a lower guide rod or guide rod means and an upper joint, instead of an upper guide rod or guide rod means.

As is shown in greater detail in FIG. 1, the vehicles or cars 2 and **2*a* are coupled together or interconnected by means of a guide arrangement 8 and 9 or, as in FIG. 7, by the guide arrangement 9 and 28, respectively, and in both such constructions of FIGS. 1 and 7 also via a connecting joint or hinge structure 21. Two substantially triangular guide rods or links or guides 8*a* and 9*a* of the guide arrangements 8 and 9 are arranged in spaced pivot bearings 10, 11 and 12, 13, respectively, which have pivot axes extending at right angles to the longitudinal plane of car 2** and are provided at a base or bottom member B so that the guides *a* and **9*a* are thereby articulated or pivoted to the related vehicle or car 2**.

These two substantially triangular guide rods or guides **8*a* an 9*a* are superimposed in substantially horizontal planes 17 and 18 and articulated or pivotably connected, for example, to a frame 3*a* of the associated bogie 3 by means of spacedly arranged pivot joints or bearings 14 and 15. In each case, overhanging or cantilevered support arms 19 and 20 are connected to the vehicles or cars 2 and 2*a*, these overhanging or cantilevered support arms 19 and 20 terminally overlapping or interengaging and between them there is located the connecting joint 21 of the related coupling device 4. On the frame 3*a* of the bogie 3, the supporting wheels 5 are rotatably mounted on a transverse or transversely extending or oriented wheel axle 22 which is located between the spaced pivot joints or bearings or bearing means 14 and 15 of the guide rods or guides 8*a* and 9*a***, respectively.

In the previously briefly considered modified embodiment according to FIG. 7, a guide arrangement is formed from or constituted by the lower guide rod or guide **9*a* and an upper joint or pivot structure 29, which is positioned between the frame 3*a* of the bogie 3 and the support arm 20 of the neighboring vehicle or car 2 or 2*a***, as the case may be. This upper joint or pivot structure 29 can comprise a universal joint or a simple connection with a vertical pivot or axis of rotation.

Figure 3:
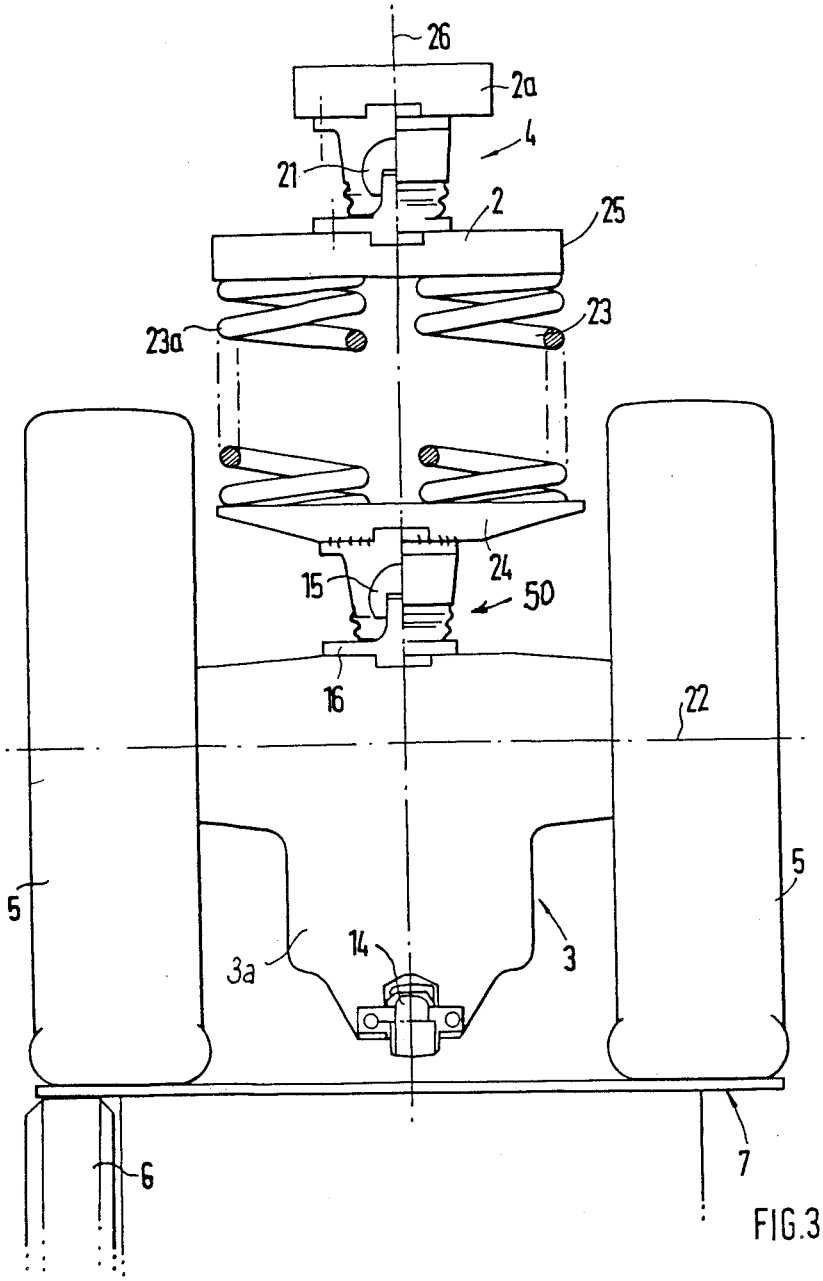
FIG. 3 is a view of the axle suspension of the vehicle or car looking in the direction of the arrow Z in FIG. 1.

Spring elements 23 and 23*a* are used for supporting the vehicles or cars 2 and 2*a*, respectively, towards or in the direction of the associated bogie 3. These spring elements or springs 23 and 23*a* are positioned between a bogie-side carrier plate 24 rigidly connected with the guide arrangement 8 and a support arm-side support plate 25 which is fixedly connected with the related vehicle or car 2 or 2*a*. The carrier plate 24 simultaneously forms part of the bearing or pivot joint 15. FIG. 3 shows in exemplary manner, two spring elements or springs 23 and 23*a*. However, it would also be possible to utilize more than two such spring elements 23 and 23*a*, which could also be provided with a shock absorber.

Figure 4:
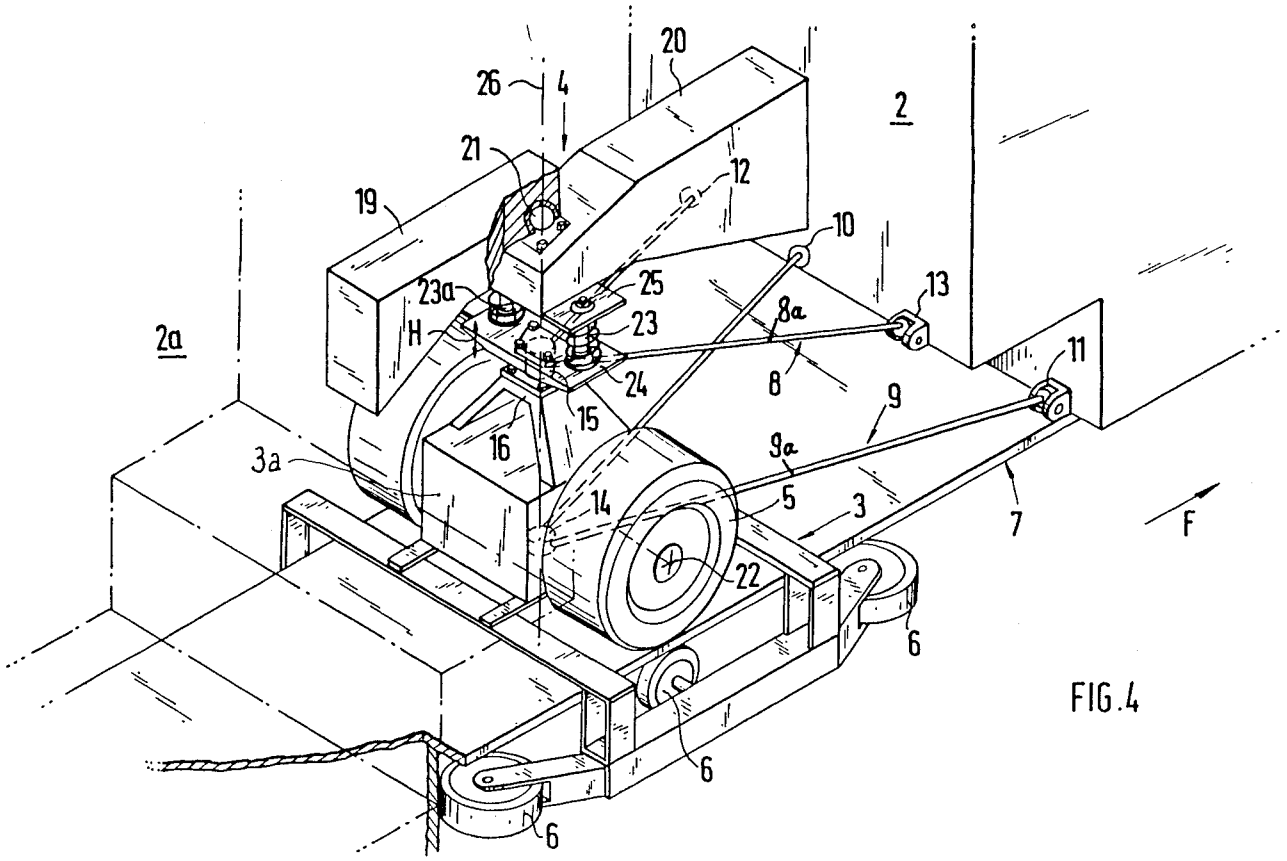
FIG. 4 is a perspective illustration of the axle suspension with guide rods, support arms and steering axis.
Figure 5:
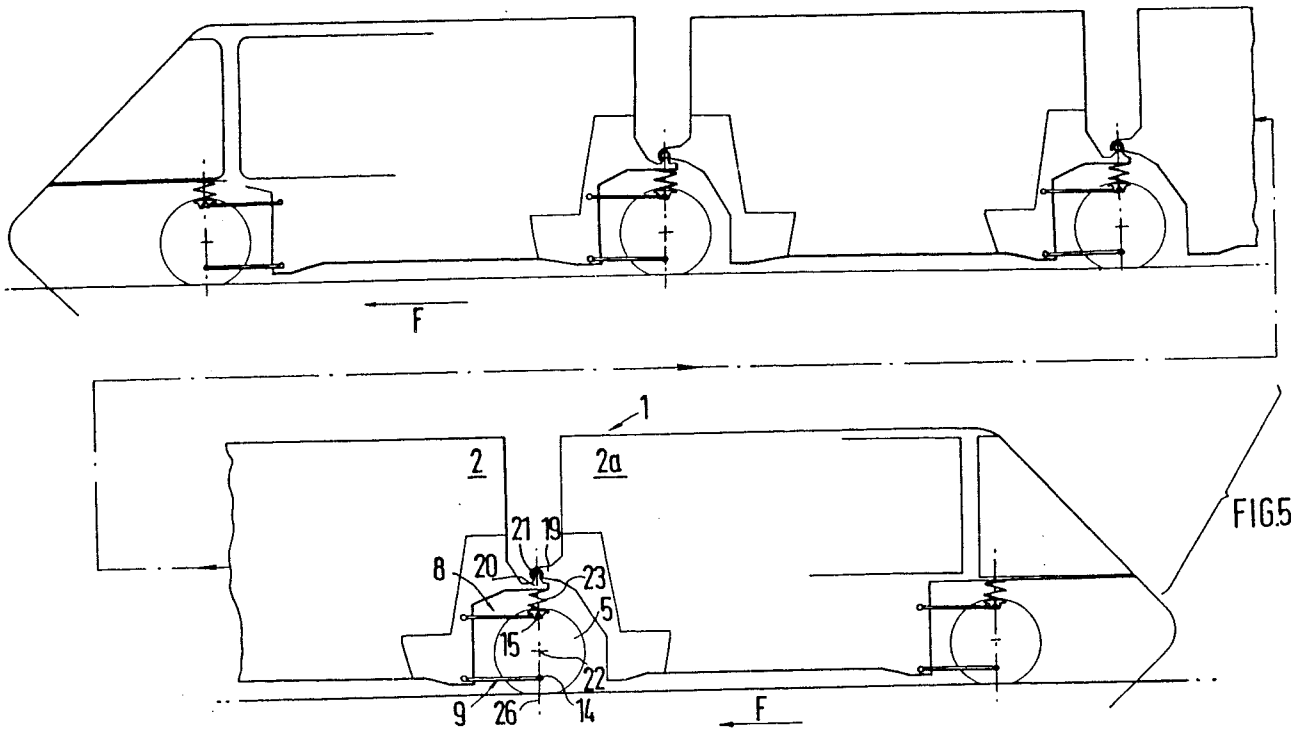
FIG. 5 is a side view of a monorail or monorail system containing several vehicles or cars

As shown in FIG. 4, both the carrier plate 24 and the support or bracket plate 25 are positioned roughly or approximately centrally to the steering axis 26 and are connected to the same vehicle or car 2 via the triangular guide rods 8*a* and 9*a*, and via the support arm 20. In the case of a possible movement of the bogie 3, whose degree of freedom of movement is restricted by the triangular guide rods 8*a* and 9*a*, the carrier plate 24 and the support or bracket plate 25 can consequently move in a substantially vertical direction and as a result of the elasticity in the bearings and joints, a limited defined transverse and longitudinal movement is also possible. This arrangement of the spring elements 23 and 23*a* between the parts or components 24 and 25 which only slightly move in the transverse and longitudinal directions, for example, during steering, only leads to a loading of the springs or spring elements 23 and 23*a* in the elevated or upright direction H, so that an optimum matching or coordination of the spring characteristic for this one loading direction is possible.

The upper connecting joint 21 of the coupling device 4 and the guide rod bearings 14 and 15 (FIG. 1) and, according to the modified embodiment of FIG. 7, the guide rod bearing 14 and the upper joint or pivot structure 29 are arranged in such a manner that a steering axis 26 is formed or defined. This steering axis 26 is preferably vertically oriented or aligned or can have minor deviations from the vertical and is located in a substantially vertical median longitudinal plane X-X of the related vehicle or car 2 and 2*a*. In addition, the steering axis 26 passes through the wheel axle 22 of the supporting or support wheels 5.

Figure 2:
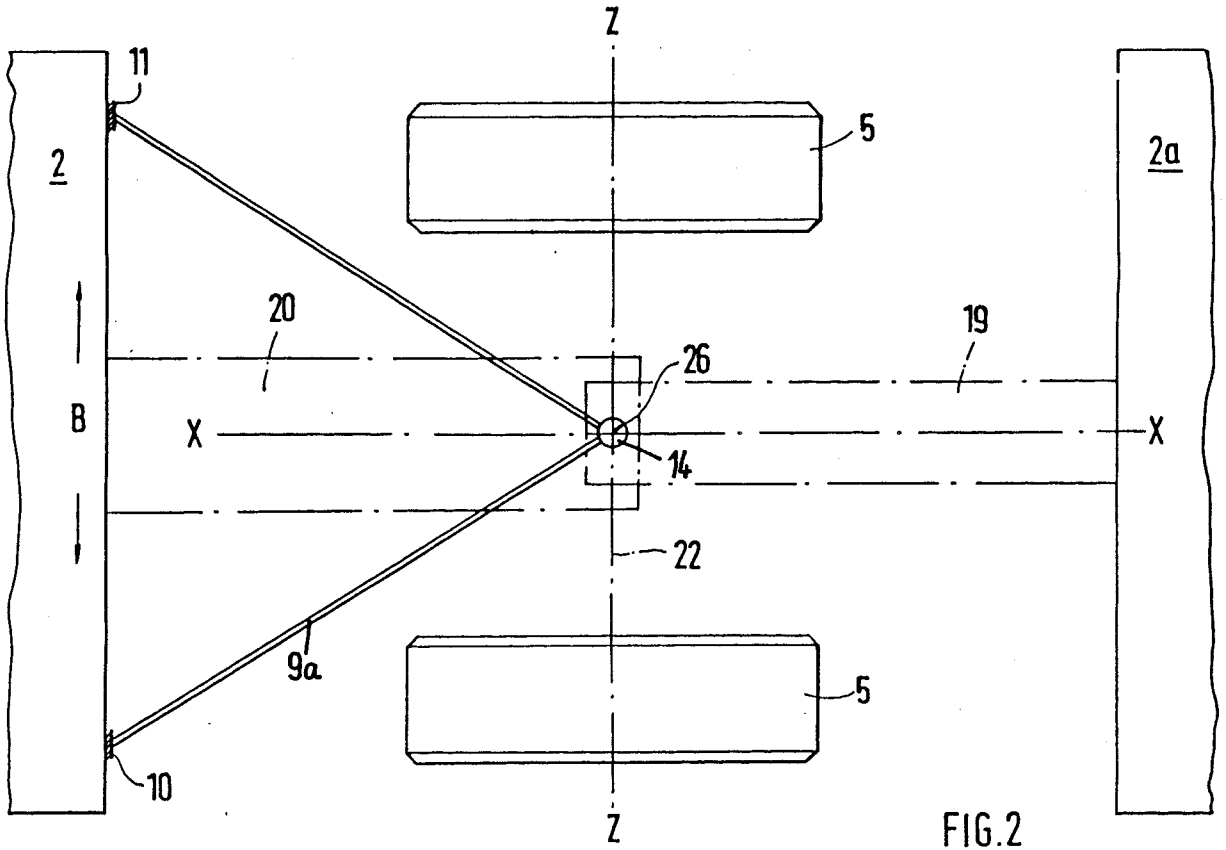
FIG. 2 is a plan view of the arrangement of FIG. 1.

As can be gathered from FIG. 2, the connecting joint 21, the bearings 14 and 15, or the bearing 14 and the upper joint or pivot structure 29 (FIG. 7), as well as the wheel axle 22 are mutually oriented such that the steering axis 26 is located in the intersection line between the substantially vertical median longitudinal plane X—X and the substantially vertical transverse plane Z—Z which passes through the wheel axle 22. Such a position of the steering axis 26 is defined in an optimum manner and minor deviations in the position of the steering axis 26 from the intersection line for constructional reasons are quite possible.

The upper guide rod arrangement or guide arrangement 8 is provided at its car-side articulation points with the bearings 12 and 13 (see for instance, FIG. 4) which are, for instance, constructed as universal or Cardan joints possessing a certain elasticity. The bogie-side pivot joint or bearing 15 comprises a single joint which receives or houses the carrier plate 24. This pivot joint or bearing 15 also has a certain elasticity. The lower guide rod arrangement or guide arrangement 9 is provided on the vehicle or car side with the same universal or Cardan joints or bearings 10 and 11 as is the case for the guide rod arrangement or guide arrangement 8, so that a universal or Cardan joint 14 is also provided on the bogie side.

Figure 6:
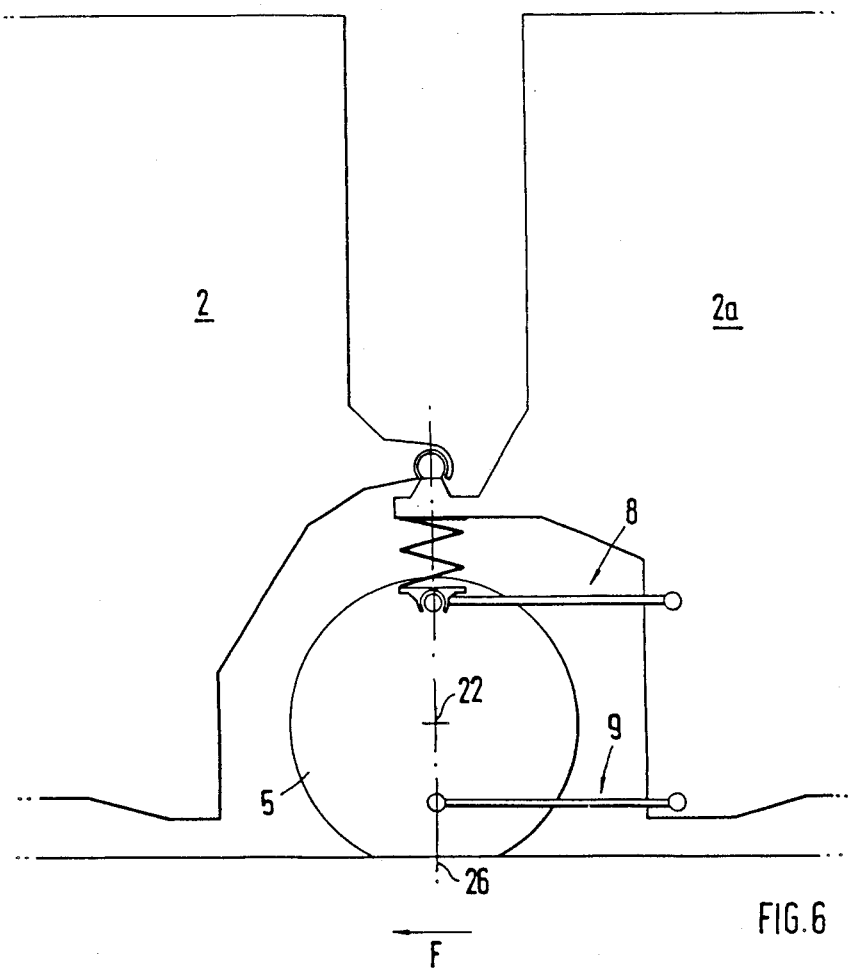
FIG. 6 illustrates a further construction of an axle suspension with a guide rod articulated or pivoted to the drawn or trailing vehicle or car.

According to another variant construction of the invention, when considered in the direction of vehicle or car travel F, the wheel axle 22 can be positioned slightly upstream or downstream of the steering axis 26. It is also possible to articulate or hingedly connect the guide rods 8*a* and 9*a* of the guide arrangements 8 and 9, respectively, to the pulled or drawn vehicle or car 2*a* instead of to the pulling or drawing vehicle or car 2, as shown in the modified embodiment of FIG. 6.

While there are shown and described present preferred embodiments of the invention, it is to be distinctly understood that the invention is not limited thereto, but may be otherwise variously embodied and practiced within the scope of the following claims. Accordingly,

What I claim is:

1. A rail vehicle, particularly a monorail, comprising:
a plurality of cars defining adjacently arranged cars;
each of said cars having a median longitudinal plane;
interconnecting a means including a respective coupling device for interconnecting two adjacently arranged cars;
a respective bogie disposed between each of said two adjacently arranged cars and having a longitudinally extending vertically oriented median plane;
each said bogie being provided with axle suspension means for carrying and supporting guide wheels capable of running on a track;
said axle suspension means including a wheel axle provided for said supporting wheels;
a guide arrangement supported on the bogie;
said guide arrangement including said interconnecting means and being provided with at least bearing means in said plane of said bogie;
spaced pivot means on an end of one only of each of said adjacently arranged cars and having pivot axes extending at a right angle to the said longitudinal plane of said one car;
guide means extending from said bearing means only to said spaced pivot means;
each said coupling device being provided with a connecting joint; and
said connecting joint together with said guide arrangement forming a steering axis which, in said median longitudinal planes of each two adjacently arranged ones of said cars, passes both through said connecting joint and through said bearing means of said guide arrangement supported on said bogie,
said guide arrangement maintaining said longitudinal plane of said one car in an orientation to substantially contain said steering axis.

2. The rail vehicle as defined in claim 1, wherein:
said guide arrangement being provided with joint means in said vertical plane;
a second pair of spaced pivot means on said end of each of said cars and having pivot axes extending at a right angle to the said longitudinal plane of said one car;
second guide means extending from said joint means only to said second pivot means; and
said connecting joint which together with said guide arrangement forms said steering axis which, in said substantially vertical median longitudinal planes of each two adjacently arranged ones of said cars, passes both through said connecting joint and through said bearing means and through said joint means of said guide arrangement supported on said bogie and through said wheel axle of the supporting wheels.

3. The rail vehicle as defined in claim 1, wherein:

said guide means comprises guide rods forming substantially a triangle with said bearing means and spaced pivot means;

base means provided for said one of said adjacently arranged cars which is disposed neighboring said bogie;

said pivot means being car bearings provided for said one of said adjacently arranged cars which is disposed neighboring said bogie; and means for articulatingly supporting said guide rods in said car bearings at said base means.

4. The rail vehicle as defined in claim 1, wherein:

said guide arrangement comprises joint means disposed in said steering axis;

said interconnecting means includes a support arm connected from said one of said adjacently arranged cars to said joint means; and said guide arrangement being positioned between said bogie and said support arm of said one adjacently arranged car.

5. The rail vehicle as defined in claim 1, wherein:

said bogie includes a frame;

said wheel axle is mounted on said frame of said bogie;

said bearing means of said guide arrangement comprising at least two bearings arranged at said bogie; and said wheel axle being positioned between said two bearings arranged at said bogie in a common substantially vertical transverse plane extending through said at least two bearings and said connecting joint.

6. The rail vehicle as defined in claim 5, wherein:

said common substantially vertical transverse plane and the substantially vertical median longitudinal plane of one of said two adjacently arranged cars intersect at a predeterminate intersecting line; and said steering axis is disposed substantially in said predeterminate intersecting line between the common substantially vertical transverse plane and the substantially vertical median longitudinal plane.

7. The rail vehicle as defined in claim 5, further including:

an upper support arm provided at one of said adjacently arranged cars;

a lower support arm provided at the other one of said adjacently arranged cars;

said upper support arm engaging over said lower support arm and said upper and lower support arms being part of said interconnecting means;

said connecting joint of said coupling device being positioned above the two bearings between said upper support arm and said lower support arm;

a support plate provided on said lower support arm;

said guide arrangement comprising two substantially triangular guide rod means one of which is said guide means;

a carrier plate fixedly connected with one of said two substantially triangular guide rod means of said guide arrangement; and at least one spring element disposed between said support plate on said lower support arm and said carrier plate.

8. The rail vehicle as defined in claim 7, wherein:

said lower support arm at which there is provided said support plate and said two substantially triangular guide rod means and said bogie are connected to the same said one car such that said support plate and said carrier plate are only mutually adjustable in a substantially upright direction.

9. The rail vehicle as defined in claim 3, wherein:

said plurality of cars have a predeterminate direction of travel;

one of said cars defining a drawn car having said car bearings; and said guide rods, considered in said predetermined direction of car travel, are secured in said bearings on said drawn car 10. The rail vehicle as defined in claim 3, wherein:

said plurality of cars have a predeterminate direction of travel;

one of said cars defining a pulling car having said car bearings; and the substantially triangular guide rods, considered in the direction of car travel, are secured in said bearings on said pulling car.

11. The rail vehicle as defined in claim 1, wherein:

said plurality of cars have a predeterminate direction of travel;

said wheel axle, considered with respect to said predetermined direction of car travel, is positioned upstream of the substantially vertical steering axis.

12. The rail vehicle as defined in claim 1, wherein:

said plurality of cars have a predeterminate direction of travel;

said wheel axle, considered with respect to the predetermined direction of car travel, is positioned downstream of the substantially vertical steering axis.

13. A rail vehicle, particularly a monorail, comprising:

at least two cars defining adjacently arranged cars;

each of said at least two cars having a median longitudinal plane;

interconnecting means including a coupling device for interconnecting said at least two adjacently arranged cars;

a bogie disposed between said at least two arranged cars and having a longitudinally extending vertically oriented medium plane;

said bogie being provided with at least supporting wheels;

a wheel axle provided for said supporting wheels;

a guide arrangement provided for the bogie;

said guide arrangement including said interconnecting means and being provided with at least bearing means in said plane of said bogie;

spaced pivot means on an end of one only of each of said adjacently arranged cars and having pivot axes extending at a right angle to said longitudinal plane of said one car;

guide means extending from said bearing means only to said spaced pivot means;

said coupling device being provided with a connecting joint; and said connecting joint together with said guide arrangement forming a steering axis which, in said median longitudinal planes of said at least two adjacently arranged cars, passes both through said connecting joint and through said bearing means of said guide arrangement and through said wheel axle of the supporting wheels, said guide arrangement maintaining said longitudinal plane of said one car in an orientation to substantially contain said steering axis.

14. A rail vehicle, particularly a monorail, comprising:

at least two cars defining adjacently arranged cars;

each of said at least two cars having a median longitudinal plane;

interconnecting means including a coupling device for interconnecting said at least two adjacently arranged cars;

a bogie disposed between said at least two adjacently arranged cars and having a longitudinally extending vertically oriented median plane;

said bogie being provided with at least supporting wheels;

a wheel axle provided for said supporting wheels;

a guide arrangement provided for the bogie;

said guide arrangement including said interconnecting means and being provided with at least one bearing and at least one pivot joint both in said plane of said bogie;

spaced pivot means on an end of one only of each of said adjacently arranged cars and having pivot axes extending at right angles to said longitudinal plane of said one car;

guide means extending from said one bearing only to said spaced pivot means;

said coupling device being provided with a connecting joint;

said pivot joint being disposed under said interconnecting means adjacent said connecting joint; and said connecting joint together with said guide arrangement forming a steering axis which, in said median longitudinal planes of said at least two adjacently arranged cars, passes both through said connecting joint and through said at least one bearing and said at least one pivot joint and through said wheel axle of the supporting wheels, said guide arrangement maintaining said longitudinal plane of said one car in an orientation to substantially contain said steering axis.

15. A rail vehicle comprising:

two adjacently arranged cars having facing ends, a bogie arranged between said ends of said adjacent cars, said cars and said bogie having respective longitudinally extending median planes, the facing end of only one of said cars having a pair of horizontally spaced pivot means having pivot axes extending substantially at right angles with respect to said longitudinally extending median plane of said one car, said longitudinally extending median plane of said bogie being vertically oriented, said bogie having frame means, wheel axle means carried by said frame means, said frame means including a plurality of vertically spaced pivot means defining a pivot axis of said bogie located in said vertically oriented longitudinally extending median plane thereof, means for connecting said cars via one of said vertically spaced pivot means, interconnecting means extending between said one car and said vertically spaced pivot means of said frame means, said interconnecting means comprising a pair of guide means pivotally connected to said pair of horizontally spaced pivot means and together to at least a second one of said vertically spaced pivot means for maintaining said longitudinally extending median plane of said one car in an orientation to substantially contain said pivot axis of said bogie and to maintain said pivot axis in a substantially upright orientation within said vertically oriented longitudinally extending median plane of said bogie.

16. A rail vehicle according to claim 15, wherein said ne vertically spaced pivot means includes a universal joint intersected by said pivot axis and defining a coupling.

17. A rail vehicle according to claim 15, wherein said one facing car end has a second pair of horizontally spaced pivot means having pivot axes extending at substantially right angles with respect to the longitudinally extending median plane of said one car and wherein said interconnecting means includes a second pair of guide means pivotally connected respectively to said second pair of horizontally spaced pivot means and together to a third one of said vertically spaced pivot means.

18. A rail vehicle according to claim 17, wherein said wheel axle means is a single support wheel axle and wherein said pivot axis substantially intersects said support wheel axle.

19. A rail vehicle according to claim 17, wherein each of said first mentioned and second pairs of horizontal spaced pivot means includes a pair of horizontally spaced universal bearing means and wherein each of said guide means is formed by a triangular rod structure, pivotably secured to one pair of horizontally spaced universal bearing means and converging towards said bogie.

20. A rail vehicle according to claim 17, wherein said one of said vertically spaced pivot means includes a universal joint intersected by said pivot axis and defining a coupling and wherein carrier means including resilient means are provided on said frame means and arranged to cooperate with said universal joint.

21. A rail vehicle according to claim 15 wherein only said second one of said vertically spaced pivot means is below said wheel axle means.

22. A rail vehicle according to claim 17 wherein said second and third pivot means are respectively below and above said wheel axle means.

23. A rail vehicle according to claim 22 wherein said second and third pivot means are respectively in said one and second horizontal planes.

24. A rail vehicle according to claim 22 including spring means between said one and third pivot means.

* * * * *